138-110 SR
10/22/85 XR 4,548,357

United States Patent [19]

Schmidt

[11] Patent Number: 4,548,357

[45] Date of Patent: Oct. 22, 1985

[54] SPRINKLER DEVICE FOR A LAWN CHAIR

[76] Inventor: Ted F. Schmidt, 6538 N. Allen Rd. #75, Peoria, Ill. 61614

[21] Appl. No.: 559,742

[22] Filed: Dec. 9, 1983

[51] Int. Cl.[4] ..... B05B 15/06; A47C 7/72

[52] U.S. Cl. ..... 239/289; 138/110; 138/172; 297/180

[58] Field of Search ..... 239/289, 269, 266; 297/180; 138/DIG. 8, 110, 172, 178; 128/366, 911; 403/41; 248/74.2; 24/265 C, 290, 652, 688

[56] References Cited

U.S. PATENT DOCUMENTS

| | | | |
|---|---|---|---|
| 1,617,435 | 2/1927 | Coleman . | |
| 2,314,525 | 3/1943 | Summers | 239/269 |
| 2,770,812 | 11/1956 | Whiteside | 239/289 |
| 3,295,886 | 1/1967 | Goldmerstein . | |
| 3,363,268 | 1/1968 | Friedlander | 239/289 |
| 3,463,440 | 5/1967 | Libby, Jr. | 248/487 |
| 3,539,181 | 11/1970 | Larson | 272/56.5 |
| 3,625,434 | 12/1971 | Kitover | 239/289 |
| 3,688,775 | 9/1972 | Raymann | 128/366 |
| 4,261,363 | 4/1981 | Russo | 128/DIG. 26 |
| 4,320,783 | 3/1982 | Neal | 138/DIG. 8 |
| 4,372,511 | 2/1983 | Knowles | 403/41 X |

*Primary Examiner*—Jeffrey V. Nase
*Attorney, Agent, or Firm*—McCaleb, Lucas & Brugman

[57] ABSTRACT

A sprinkler device which is universally attachable to a wide variety of lawn chairs and recliners for sprinkling a person sunbathing. The device comprises a "U" shaped length of flexible hose, one end of which is closed and the other end of which is connected to a source of water under pressure through a control valve. Side legs of the hose have water emitting apertures and extend along opposite sides of the chair. A crossover leg connects the side legs across one end of the chair. Wide, flat 90° elbow guide fittings maintain right angle bends at the corners of the hose between the side legs and the crossover leg. This enables the crossover leg to maintain its position by gravity alone and prevents the crossover leg from bending, twisting, and bowing when water pressure is applied.

4 Claims, 7 Drawing Figures

SPRINKLER DEVICE FOR A LAWN CHAIR

BACKGROUND OF THE INVENTION

The present invention relates to use of a lawn chair or recliner for sunbathing purposes and more particularly to a sprinkling device to enhance the tanning effect of the solar rays while maintaining a comfortably cool body temperature.

It is generally believed that the combination of sunlight and water on the bare human body beneficially accelerates the rate of tanning and has other desirable theraputic effects while keeping the body temperature comfortably cool. Previous combination sunbathing and sprinkling apparatus had several disadvantages so limiting their use that they never became generally available. For example, U.S. Pat. No. 2,770,812 discloses a body supporting and bathing device in which sprinkler openings directed toward the sunbather are provided in the supporting framework of the device itself, this has the drawback of being limited for all practical purposes to a flat, horizontal frame and is not readily adaptable to conventional lawn chairs and recliners having tiltably adjustable head and foot sections. Another example of the prior art, U.S. Pat. No. 3,625,434, discloses a lawn chair in which the tubular supporting framework comprises conduits and mounting means for a series of water nozzles directed toward the sunbather; this has the drawback of requiring special fittings into the frame and special watertight joints between sections and is limited to use on only a few special types of lawn chairs where these adaptations are possible.

Instead of using the lawn chair framework as tubular conduit means, it is far preferable to have the water in a separate conduit, such as a sprinkler hose fastened along opposite sides. Where the chair is of the type having head and foot end sections which are vertically adjustable relative to an intermediate section, it is important that the hose be flexible so it can bend at the joints between the frame sections. However, in a hose having such flexibility, the crossover portion will twist, bend, and distort outwardly if internal water pressure is applied without the present invention.

SUMMARY OF THE INVENTION

It is a general object of the present invention to provide a sprinkler device which is simple, inexpensive, effective, and which can be fitted quickly onto any of a wide variety of lawn chairs and recliners without altering the basic construction, by a person having limited mechanical ability, and without special tools.

Another object of the present invention is to fasten a flexible, apertured sprinkler hose along opposite sides of a rectangular lawn chair or recliner frame with an interconnecting crossover hose portion at one end of the frame.

An important part of the present invention is to provide 90° elbow guide fittings engaging the flexible hose at the corners of the frame to guide the crossover portion flat and straight across the end of the frame, thereby avoiding the above-mentioned twisting, bending, and distorting when water pressure is applied.

BRIEF DESCRIPTION OF THE DRAWINGS

Other objects and advantages will be apparent from the following description taken in connection with the accompanying drawing in which.

Like parts are designated by like reference numerals throughout the figures of the drawing.

DESCRIPTION OF THE PREFERRED EMBODIMENT

Figure 1:
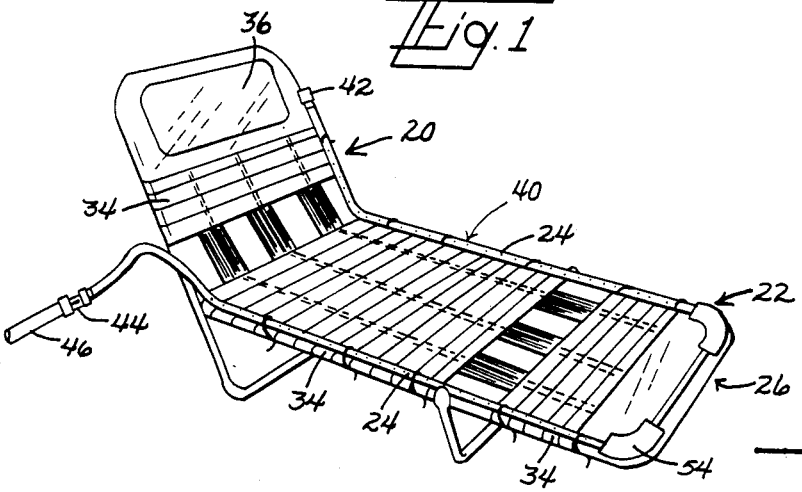
FIG. 1 is a perspective view of a lawn chair of the "chaise longue" type employing a sprinkler device illustrating the present invention.
Figure 5:
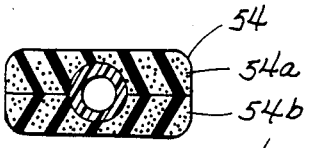
FIG. 5 is a cross-sectional view of FIG. 4 taken along line 5—5.

Referring now more specifically to the drawing, a conventional lawn chair 20 is fitted with one form of the improved sprinkler device generally designated 22.

The lawn chair 20 is adjustable, having a generally rectangular frame means including side frame members 24 and head and foot cross-frame members 26. The chair has head and foot sections 28 and 30 pivoted in the usual way for up and down adjustment relative to an intermediate seat section 32. In the example shown, the chair has a plurality of webbed areas 34 and smooth plastic or cushioned head and foot panels 36 and 38 at extreme opposite ends. Alternatively, the sprinkler device may be used on a recliner of the type in which the head, foot, and seat sections are unitary without vertical adjustability at either or both ends.

The sprinkler device 22 comprises a flexible hose 40 closed at one end by a plug 42 and having an on-off control valve 44 at the opposite end connected to a source of water under pressure through a supply hose 46. It is of sufficient length to extend in a "U"-configuration having side legs 48 and 50 extending along the chair side frame members 24,24, and having a crossover leg 52 interconnecting the side legs across the foot end section 30 of the chair frame means.

Figure 2:
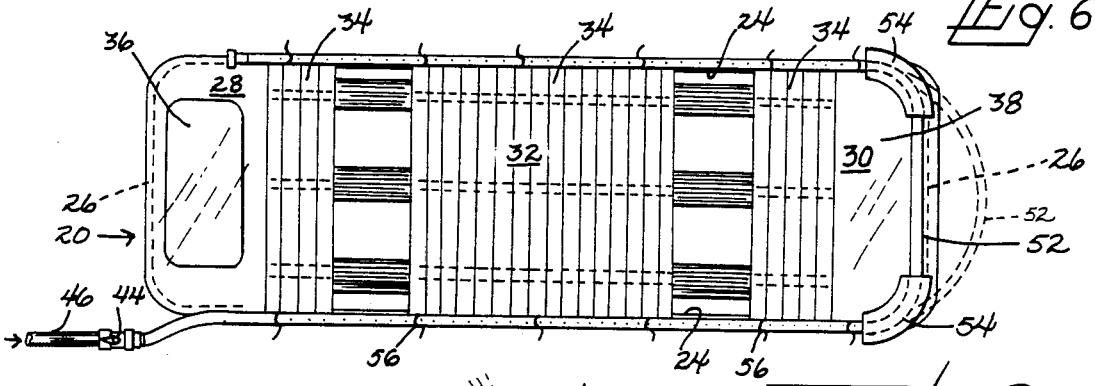
FIG. 2 is a top, plan view of the lawn chair of FIG. 1 showing the head section lowered for use as a horizontal recliner.
Figure 3:
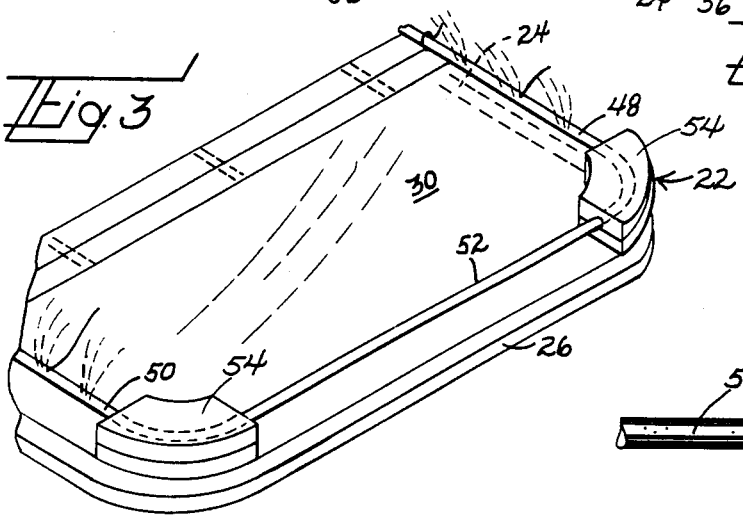
FIG. 3 is a fragmentary enlarged view of FIG. 1.
Figure 4:
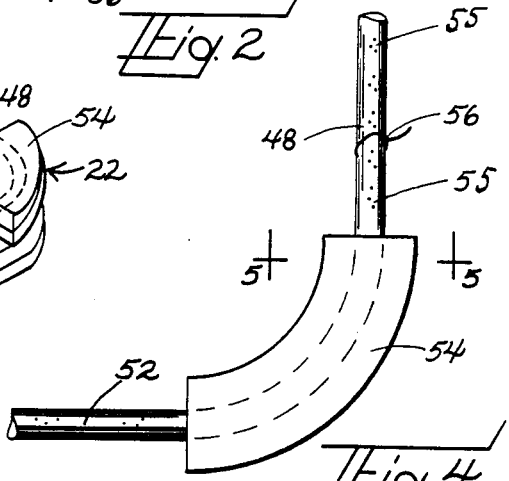
FIG. 4 is a fragmentary enlarged view of FIG. 2.
Figure 7:
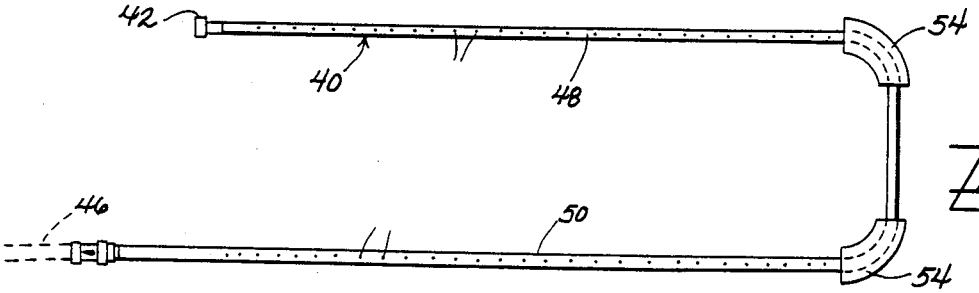
FIG. 7 is a top plan view of the improved sprinkler device itself.

A pair of 90° elbow guide fittings 54 embrace the hose at the corners of the chair where the ends of the crossover leg join the side legs. These positively constrain the hose to a right angle configuration at each corner and enable the crossover leg 52 to remain straight across the end of the chair as shown in FIGS. 2 and 3, without the necessity of tying the crossover leg to the chair end portion by any positive means. The elbow fittings 54 may be made of any suitable material. In the present case, each comprises a pair of half-sections **54*a*, 54*b*** of plastic material which are molded, adhered or otherwise attached to one another about the hose in any suitable manner.

Each hose side leg 48 and 50 is provided with a series of water-emitting sprinkler apertures 55 directed toward the center of the frame means to keep a sunbather continuously wet while on the chair, thereby enhancing the tanning effects of the solar rays while maintaining the body comfortably cool. The side legs are fastened to the chair side frames 24 by plastic ties 56

Figure 6:
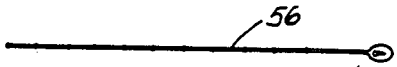
FIG. 6 is a view of a plastic tie used to fasten the sprinkler device to the lawn chair.

(FIG. 6) extending through openings in the webbed areas 34. Normally, sprinkler apertures are unnecessary in the crossover leg 52 and are not shown. However, they may be used if desired.

In the lawn chair example shown, as in many chairs of this type, the foot end panel section 30 is solid, non-webbed, and it would be objectionable to many people to make holes in it for the ties 56. By making the elbow fittings 54 as shown, with wide, flat contours resting on the foot section 30, the crossover leg 52 will remain perfectly straight and stable by gravity alone without using any of the ties 56 to hold the crossover leg in place. Further, the 90° constraint imposed on the corners of the hose by the elbow guide fittings will completely eliminate any tendency for the crossover leg 52 to twist, bend, or distort when internal water pressure is applied. By contrast, without the elbow fittings 54, the crossover leg 52 would bow forwardly as shown in broken lines in FIG. 2.

Because the hose 40 is flexible, it will readily bend if the head section 28 or foot section 30 is vertically adjusted, so a sunbather may have the option of using the apparatus in a completely prone or supine position, or in a choice of sitting positions.

Use and operation are believed to be apparent from the above description. Preferably, the hose will be assembled along the sides of the lawn chair is such a way that the sprinkler-containing side legs 48 and 50 will extend to or beyond the sunbather's shoulders, and the on-off control valve 44 will preferably be positioned so the sunbather can reach it from the chair.

The embodiment described and shown to illustrate the present invention has been necessarily specific for purposes of illustration. Alterations, extensions, and modifications would be apparent to those skilled in the art.

The embodiments of the invention in which an exclusive property or privilege is claimed are defined as follows:

1. Apparatus for sunbathing including a portable sprinkler device attached to a lawn chair or recliner having frame means including elongated side frame members, and cross frame members at the head and foot ends respectively, said sprinkler device comprising a unit including a flexible hose closed at one end and having an on-off control valve at the opposite end and being of sufficient length to end in a "U"-configuration including side legs along said side frame members, and a crossover leg interconnecting the side legs and extending at right angles thereto across one end of the frame means;

quickly attachable and detachable means for fastening said side legs to said side frame members;

a pair of 90° elbow guide fittings engaging the hose at the corners where the ends of the crossover leg join the side legs, said elbow guide fittings constraining the hose to a 90° bend at each corner against twisting and bending;

a plurality of water-emitting sprinkler apertures in said hose directed toward the center of the frame means;

whereby a person may sunbathe on said furniture beneath water sprays from said sprinkler apertures to thereby enhance the tanning effect of solar rays while maintaining a comfortable body temperature.

2. Apparatus for sunbathing according to claim 1 in which the crossover leg rests upon said one end of the frame means by gravity, is not otherwise fastened thereto, and is maintained at a substantially 90° orientation relative to the side legs solely by means of the 90° elbow fittings.

3. A sprinkler device for an adjustable lawn chair comprising:

a flexible hose closed at one end and having an on-off control valve at the opposite end;

a pair of 90° elbow guide fittings spaced apart at intermediate portions of said hose, said hose secured in said elbow guide fittings to define a crossover leg between said elbow guide fittings and a pair of side legs beyond the elbow guide fittings, said side legs and crossover leg forming a "U"-configuration and quickly attachable and detachable means for securing the side legs to side frame members of the lawn chair while said crossover leg extends across one end thereof, said guide fittings closely constraining said hose to eliminate any tendency for the hose to twist, bend or distort when internal water pressure is applied;

at least side legs having water-emitting sprinkler apertures for directing water into the region between said side legs and onto a person reclining on said lawn chair when the hose is connected thereto.

4. A sprinkler device according to claim 3 in which said elbow guide fittings are relatively wide and flat for stable engagement by gravity only with a top surface of the lawn chair.

* * * * *